United States Patent [19]

Sakuma et al.

[11] 4,429,197

[45] Jan. 31, 1984

[54] VACUUM POWER INTERRUPTING DEVICE

[75] Inventors: Shinzo Sakuma, Yokohama; Hifumi Yanagisawa, Sagamihara; Kazuo Tokuhata, Kanagawa; Hiroshi Miyagawa, Yokohama, all of Japan

[73] Assignees: Kabushiki Kaisha Meidensha; Kabushiki Kaisha Gemvac, both of Tokyo, Japan

[21] Appl. No.: 215,855

[22] Filed: Dec. 12, 1980

[30] Foreign Application Priority Data

Dec. 15, 1979 [JP] Japan ..... 54-163851

[51] Int. Cl.[3] ..... H01H 33/66

[52] U.S. Cl. ..... 200/144 B; 335/151

[58] Field of Search ..... 200/144 B; 335/151

[56] References Cited

U.S. PATENT DOCUMENTS

| | | | |
|---|---|---|---|
| 2,431,226 | 11/1947 | Berkey et al. | 200/144 B |
| 3,127,018 | 4/1973 | Wesoloski et al. | 200/144 B |
| 3,426,168 | 2/1969 | Hansen | 200/144 B |
| 3,471,669 | 10/1969 | Curtis | 200/144 B |
| 3,812,314 | 5/1974 | Nonken | 200/144 B |
| 3,859,486 | 1/1975 | Haese et al. | 200/144 B |
| 4,365,127 | 12/1982 | Sakuma et al. | 200/144 B |

FOREIGN PATENT DOCUMENTS

| | | | |
|---|---|---|---|
| 1020081 | 11/1958 | Fed. Rep. of Germany | 200/144 B |
| 1177546 | 12/1958 | France | 200/144 B |
| 1263375 | 2/1972 | United Kingdom . | |
| 1298448 | 12/1972 | United Kingdom | 200/144 B |
| 2010587 | 6/1979 | United Kingdom | 200/144 B |

*Primary Examiner*—Robert S. Macon

*Attorney, Agent, or Firm*—Lowe, King, Price & Becker

[57] ABSTRACT

A vacuum vessel 7 comprises a bell shaped metal casing 5, and an insulating circular end plate 6 hermetically brazed to the opening end of the metal casing. A vacuum interrupter 3 is constituted by aligning a stationary contact rod 20 with a movable contact rod 17, each having an electrical contact 8,9, within the vacuum vessel so that the latter is in contact with the former or away therefrom. A vacuum power interrupting device comprises a disk-shaped resin supporting block 4 in which the vacuum interrupter is molded. A stationary electrode 23 is connected to a stationary contact rod 20 disposed within the vacuum interrupter. A tubular insulating barrier is integrally formed with the supporting block so as to surround the stationary electrode. The vacuum power interrupting device further comprises an electromagnet supported by a plurality of supporting poles 47*a*, 47*b* extending along the outer circumferential surface of the supporting block, and an adsorbed member 44 of a magnetic material responsive to the electromagnet and supported by an insulating rod 43 connected to the movable contact rod. Thus, the armature member is in contact with or away from an iron core 52 of the electromagnet in accordance with the energized or deenergized condition of the electro magnet to bring the vacuum interrupter into an interrupted condition or a closed condition.

6 Claims, 3 Drawing Figures

VACUUM POWER INTERRUPTING DEVICE

BACKGROUND OF THE INVENTION

The present invention relates to a vacuum power interrupting device, and more particularly to a vacuum interrupting device adapted to be mounted on a power board or a switching board.

In our previous U.S. Pat. No. 4,365,127, issued Dec. 21, 1982, there is disclosed a vacuum power interrupter comprising a vacuum vessel consisting of a bell shaped metal casing, an insulating ceramic end plate hermetically brazed to the opening end of the metal casing, and a pair of contact rods disposed within the vacuum vessel so that one is in contact with the other or away therefrom.

This type of vacuum power interrupter makes it easy to enlarge an outer radius of the vacuum vessel and interrupt a large electric current, as compared with a second type of vacuum power interrupter comprising a cylindrical insulating envelope, metal end plates hermetically brazed to axial ends of the insulating envelope, respectively, and stationary and movable contact rods disposed within the insulating envelope so that the latter is movable relative to the former.

The first type of vacuum power interrupter is inexpensive and easy to fabricate since the insulating ceramic end plate is used instead of an insulating ceramic envelope which is costly.

However, with the first type of vacuum power interrupter, the following drawback occurs: an aerial creeping distance due to the electric potential which is rendered by the movable contact rod serving as an electrically charged portion through a bellows mounted on the end plate is obtained by an outer surface of the insulating end plate. Accordingly, the insulating withstanding force becomes small, resulting in that the insulating withstanding force is smaller than that of the second type of vacuum power interrupter. Consequently, the first type of vacuum power interrupter makes it difficult to interrupt high voltage.

SUMMARY OF THE INVENTION

With the above in mind, an object of the present invention is to provide a vacuum power interrupting device which makes it possible to improve a creeping flashover voltage at an outer surface of the insulating circular ceramic end plate between the opening end of a metal casing serving as an electrically charged portion and a movable contact rod.

Another object of the present invention is to provide a vacuum power interrupting device designed so that the insulating withstanding force at the inside of a vacuum interrupter is consistent with that at the outside thereof.

Another object of the present invention is to provide a vacuum power interrupting device which makes it easy to mount a vacuum interrupter to a power-board and eliminate the provision of a bushing serving as an output terminal.

Another object of the present invention is to provide a vacuum power interrupting device which makes it easy to combine an actuating unit for effecting opening and closing operation of a vacuum interrupter with the vacuum interrupter.

One aspect of the present invention is as follows: A vacuum power interrupting device with a vacuum vessel comprising a bell shaped metal casing, and an insulating end plate hermetically brazed to the opening end of the metal casing, wherein a vacuum interrupter is constituted by aligning a stationary contact rod with a movable contact rod, each having an electrical contact, within the vacuum vessel so that the latter is in contact with the former or away therefrom.

The improvement wherein the vacuum power interrupting device comprises a disk-shaped supporting block of resign in which the vacuum interrupter is molded, a stationary electrode connected to a stationary contact rod disposed within the vacuum interrupter, a cylindrical insulating barrier integrally formed with the supporting block so as to surround the stationary electrode, an electromagnet supported by a plurality of supporting poles extending along the outer circumferential surface of the supporting block, and an adsorbed member of magnetic material responsive to the adsorbed member and supported by an insulating rod connected to the movable contact rod, whereby the adsorbed member is in contact with or away from an iron core of the electromagnet in accordance with the energized or deenergized condition of the electromagnet to bring the vacuum interrupter into an interrupted condition or a closed condition.

According to the present invention, there is provided a vacuum power interrupting device comprising an interrupting unit, including a vacuum vessel therein, adapted to be mounted to a stationary part, such as a board plate, and an integral actuating unit arranged in alignment with the interrupting unit for actuating the interrupting operation of the interrupting unit so that a movable contact is in contact with a stationary contact or away therefrom. The vacuum interrupter is constituted by aligning a stationary contact rod with a movable contact rod, each rod having, within the vacuum vessel, a respective one of the electrical contacts provided on the extending end thereof, and a supporting block of synthetic insulating resin in which the whole peripheral surface of the vacuum interrupter is embedded.

In accordance with the invention, the vacuum vessel comprises a bell-shaped metal casing having a radially extending portion in the vicinity of the open end thereof, and a single insulating circular end plate. The metal casing is fitted over the end plate with the open periphery of the radially extending portion being hermetically brazed to the outer peripheral edge of one side of the end plate.

BRIEF DESCRIPTION OF DRAWINGS

In these drawings, same reference numerals denote same or similar parts of the vacuum power interrupting device.

DETAILED DESCRIPTION OF THE PREFERRED EMBODIMENT

The vacuum power interrupter essentially consists of an interrupting unit 1 constituted by molding a vacuum interrupter, and an actuating unit 2 provided integrally concentrically with the interrupting unit in order to effect an interrupting actuation.

Figure 2:
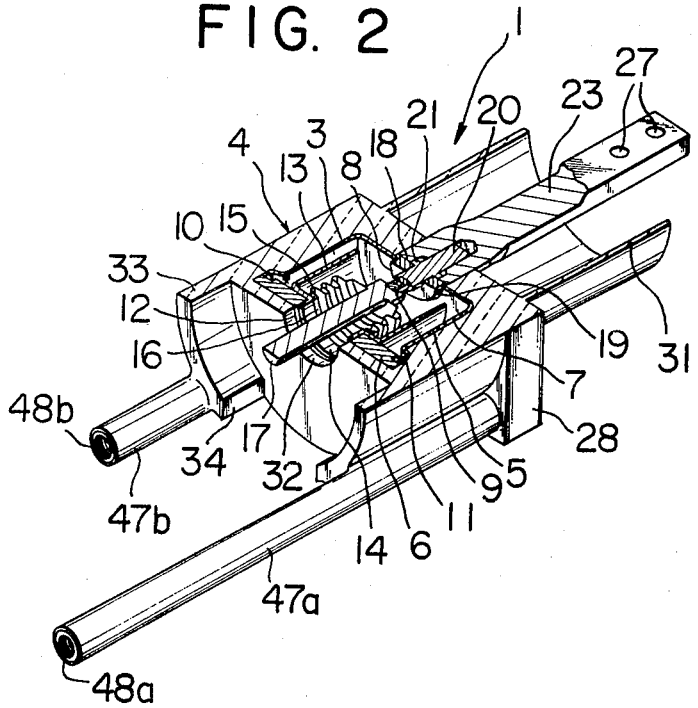
FIG. 2 is a perspective view partly in cross section of the interrupting unit shown in FIG. 1.

More particularly, interrupting unit 1, as shown in FIG. 2, comprises a bell shaped vacuum interrupter 3, and a supporting block 4 of resin molded around the vacuum interrupter. Vacuum interrupter 3 includes a vacuum vessel 7 constituted by hermetically brazing an insulating circular end plate 6 to the opening end of a bell shaped metal casing 5. Within vacuum vessel 7, there are provided stationary and movable electrical contacts 8 and 9 so that the latter is movable relative to the former. In vacuum vessel 7, metal casing 5 made of Fe-Ni-Co alloy or Fe-Ni alloy is formed to be bell shaped and provided in the vicinity of the opening end thereof with a radially extended portion 10. Metal casing 5 is fitted over insulating end plate 6 so that the opening periphery of extended portion 10 is hermetically brazed to a step portion 11 formed on the outer peripheral edge of the insulating end plate. A bore 12 is provided in the center of insulating circular plate 6. A cylindrical arc-shield member 13 (of Fe-Ni-Co alloy or Fe-Ni alloy) disposed concentrically with the center of vacuum vessel 7 is fitted into bore 12 through an annular fitting portion 14 extending outwardly in the axial direction from the opening periphery of the center of bore 12. A part of the bottom portion thereof is hermetically brazed to insulating circular end plate 6.

A bellows 15 of stainless steel or Inconel accommodated within vacuum vessel 7 is fitted into annular fitting portion 14 of arc-shield member 13 through a tubular portion 16 extending outwardly in the axial direction and is hermetically brazed thereto. A movable contact rod 17 of Cu or Cu alloy having an electrical contact 9 of Cu or Cu alloy on the extended end thereof is inserted into bore 12. More particularly, an annular radially extended portion on movable contact rod 17 is supported by bellows 15 and is hermetically brazed thereto. Movable contact rod 17 is disposed through tubular portion 16 of bellows 15 and an axial portion of annular fitting portion 14 of arc-shield member 13. Movable contact rod 17 is movable in the axial direction in accordance with contraction of bellows 15.

A circular auxiliary metal fitting 18 serving as an electricity collecting member is fitted into the bore provided in the bottom portion of metal casing 5 through fitting portion 19 projected from the circumferential surface of the auxiliary metal fitting and is hermetically brazed thereto.

A stationary lead 23 which is connected to a stationary power source or a load (not shown) is connected to auxiliary metal fitting 18 to improve electric current collecting efficiency. The detail of the stationary lead is described below. Auxiliary metal fitting 18 is made of Cu or Cu alloy. The stationary contact rod 20 having an electrical contact 8 on the extended end thereof is inserted in the central portion of auxiliary metal fitting 18. More particularly, stationary contact rod 20 is supported at flange 21 by auxiliary metal fitting 18 and is hermetically brazed thereto.

Stationary contact rod 20 can be made of Cu or Cu alloy which is the same material as that of movable contact rod 17. Stationary lead 23, which is of rectangular shape in cross section, is jointed to stationary contact rod 20 so that a screw portion 22 (see FIG. 3) provided on the stationary contact rod is threadedly connected to a screw bore 24 provided in the stationary lead. More particularly, stationary lead 23 is mounted on stationary contact rod 20 so that the end surface thereof is in contact with the surface of auxiliary metal fitting 18, thereby making it possible to obtain a large contact surface between the stationary lead and the stationary contact rod.

Stationary lead 23 is provided at an outwardly extended portion thereof with plural holes 27 enabling connection of a connecting conductor 25 thereto with bolts or nuts 26, Thus, interrupting unit 1 is connected to the power-board due to engagement between stationary lead 23 and connecting conductor 25 provided within the power-board.

Reference is now made to a method of making the above-mentioned vacuum interrupter characterized in that the stationary and movable contact rods 20 and 17 having electrical contacts 8 and 9 are disposed within the vacuum vessel so that the latter is movable relative to the former.

The method comprises the steps of provisionally assembling constituent components with brazing material interposed therebetween, and brazing the constituent components while heating and evacuating in a vacuum furnace. The completed vacuum interrupter 3 is a self-closing type characterized in that stationary electrical contact 8 is in contact with the movable electrical contact in a normal condition due to the pressure differential between the inside of the vacuum vessel and the outside thereof, and the elasticity of bellows 15.

The outer circumferential portion of vacuum power interrupter 3 together with one end of stationary lead 23 threadedly connected to stationary contact rod 20 is molded within supporting block 4. Block 4 is provided with an integral rectangular shaped flange 28 located adjacent the closed end of casing 5. In the vicinity of the outer side of flange 28, a metal fitting 30 with a screw hole (see FIG. 1) is embedded, which is used when mounting molded vacuum interrupter 3 to a board wall 29 of the power-board shown in FIG. 3.

Flange 28 is integrally formed with a cylindrical or tubular stationary insulating barrier 31 which concentrically surrounds stationary lead 23. One object of providing barrier 31 is to insulate stationary lead 23 with respect to board wall 29 of which electrical potential is earth potential. The other object thereof is to insulate between different phases when using the vacuum power interrupter for use in two or three phases.

Figure 3:
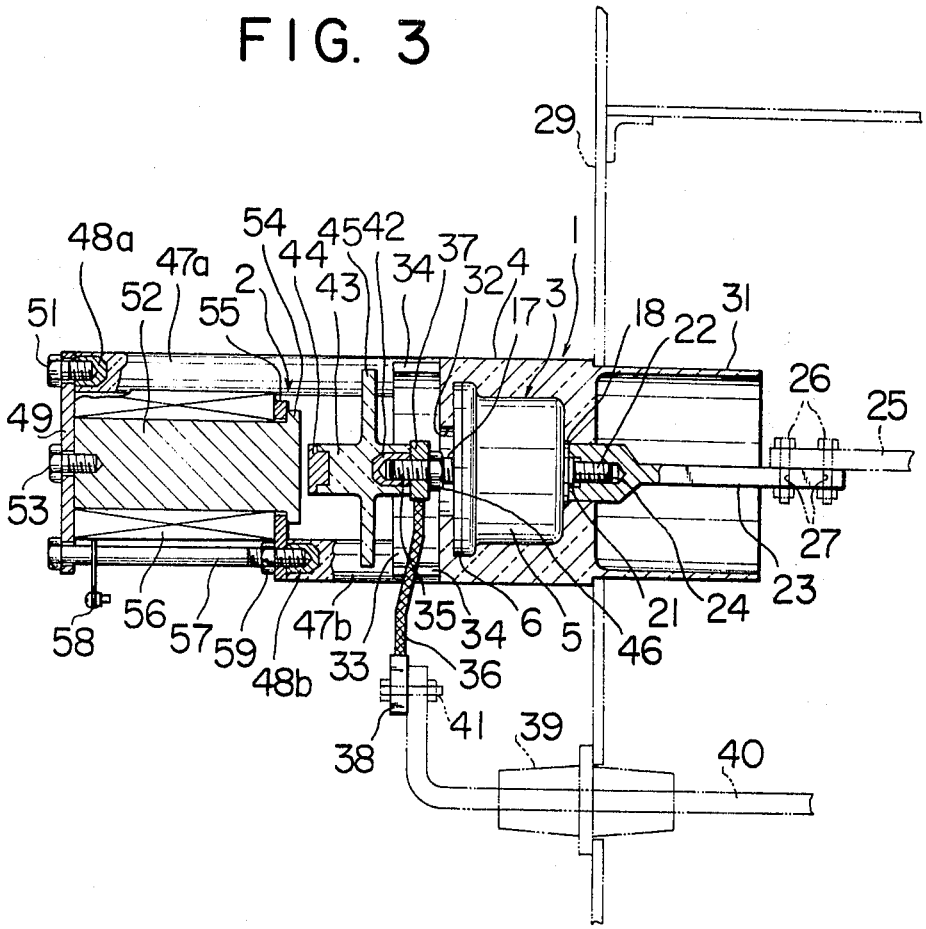
FIG. 3 is a longitudinal cross sectional view illustrating a vacuum power interrupting device shown in FIG. 2.

Vacuum interrupter 3 is attached to the board-plate so that stationary insulating barrier 31 is inserted in board wall 29 (see FIG. 3). Actually, a clamping tool (not shown) is screw-threadedly connected to metal fitting portions 30 provided in flange 28 to establish the connection between vacuum interrupter 3 and board wall 29.

Thus, the vacuum power interrupting device makes it possible to provide a construction serving as a bushing comprising stationary lead 23 and insulating barrier 31 concentrically surrounding the stationary lead.

Movable contact rod 17 projects through a bore 32 communicating with bore 12 provided in insulating circular end plate 6. Supporting block 4 is provided at the peripheral edge thereof on the side of insulating circular end plate 6 with a cylindrical insulating barrier 33 surrounding movable contact rod 17 projecting through bore 32. Insulating barrier 33 is provided to effect an insulation between different phases when using the vacuum power interrupter for use in two or three phases. Insulating barrier 33 is provided with a plurality of rectangular shaped recesses 34 to permit a movable lead (described infra) to be conducted thereinto.

Movable contact rod 17 projects to such an extent that the extending length thereof is the same as the axial length of insulating barrier 33. Movable contact rod 17 is provided at its outwardly projecting portion with a screw portion 35. One end of a flexible lead conductor 36 is connected to screw portion 35 so that a ring shaped connecting metal fitting 37 provided at one end of flexible lead conductor 36 is fitted over screw portion 35. The other end of lead conductor 36 is electrically connected to a connecting conductor 40 projecting from board wall 29 through a bushing 39 by means of a nut or bolt 41.

An insulating rod 43 of resin has embedded at one end thereof a metal fitting 42 which is screw-threadedly connected to portion 35 of movable contact rod 17. On the other end of insulating rod 43, an armature member 44 is embedded. Insulating rod 43 is provided for insulating between movable contact rod 17 and actuating unit 2 of which detail will be referred to later. Insulating rod 43 has integrally formed in the middle portion thereof a flange 45 for increasing the creeping surface withstanding voltage.

Insulating rod 43 makes it possible to adjust a relative position with respect to movable contact rod 17, that is, a gap formed between the ends of an iron core 52 of actuating unit 2 and the insulating rod by rotating the rod in a suitable direction. Insulating rod 43 is fixed at a desired position by means of a lock nut 46 threadedly connected to screw portion 35 of movable contact rod 17 so as to clamp the connecting metal fitting 37 provided on end of lead conductor 36.

Along the outer circumferential surface of supporting block 4, there are provided a plurality of supporting poles **47*a* and 47*b* (of different lengths) extending in the moving direction of contact rod 17. Four poles are provided in the preferred embodiment. On each end thereof, metal fittings 48*a* and 48*b* are embedded. Supporting poles 47*a* and 47*b* are provided for mounting actuating unit 2 which comprises an electromagnet for effecting opening and closing operation of interrupting unit 1 so that the actuating unit is disposed concentrically with the interrupting unit. On the end portion of supporting pole 47*a*, a rectangular shaped mounting plate 49 constituting a part of actuating unit 2 is mounted by means of screws 51 received within metal fittings 48*a* through a plurality of holes 50**.

Mounting plate 49 constitutes a magnetic path forming unit, together with a connecting member which will be described later. Mounting plate 49 is made of a magnetic material, such as iron. On the central portion thereof, the bottom portion of iron core 52 of the electromagnet (disposed concentrically with movable contact rod 17 and insulating rod 43) is integrally mounted by means of a screw 53. The top portion of iron core 52 is disposed so as to oppose armature member 44. On the top axial end thereof, a flange 54 is integrally mounted. Projecting laterally from the top end of iron core 52, a winding support member 55 is fitted over flange 54 and fixed thereto. Between winding support member 55 and mounting plate 49, winding 56 constituting an electromagnet is clamped and wound thereon.

A connecting rod 57 of magnetic material, such as a bolt, is inserted into hole 50 of plate 49. The end of connecting rod 57 is disposed to penetrate winding support member 55 in the extending direction thereof and is threadedly connected to metal fitting **48*b* provided on the extended end of supporting pole 47*b***.

According to the foregoing embodiment, actuating unit 2 comprises a flange 54 provided on the top portion of iron core 52 and a winding support member 55 of nonmagnetic material fitted into the flange so that it is supported thereby. However, the structure of actuating unit 2 is not limited to that defined by the aforementioned embodiment. For instance, a member for supporting a winding having a width that is relatively narrow and integrally formed with iron core 52 may be used for the same purpose.

The armature member 44 provided adjacent top end of the iron core 52 is preferably formed so that its radius is as large as possible. Further, it is desirable to enlarge top portion 54 of the iron core which constitutes a magnetic path together with mounting plate 49. In other words, it is necessary to select the mounting position of metal fitting **48*b* embedded in support pole 47*b* so that the metal fitting is away from the top end of iron core 52 for a predetermined interval (in the right direction in FIG. 3). Thus, it is desirable that most of a magnetic flux produced by the electromagnet passes through iron core 52, armature member 44, metal fitting 48*b*, connecting rod 57, and mounting plate 49**.

Figure 1:
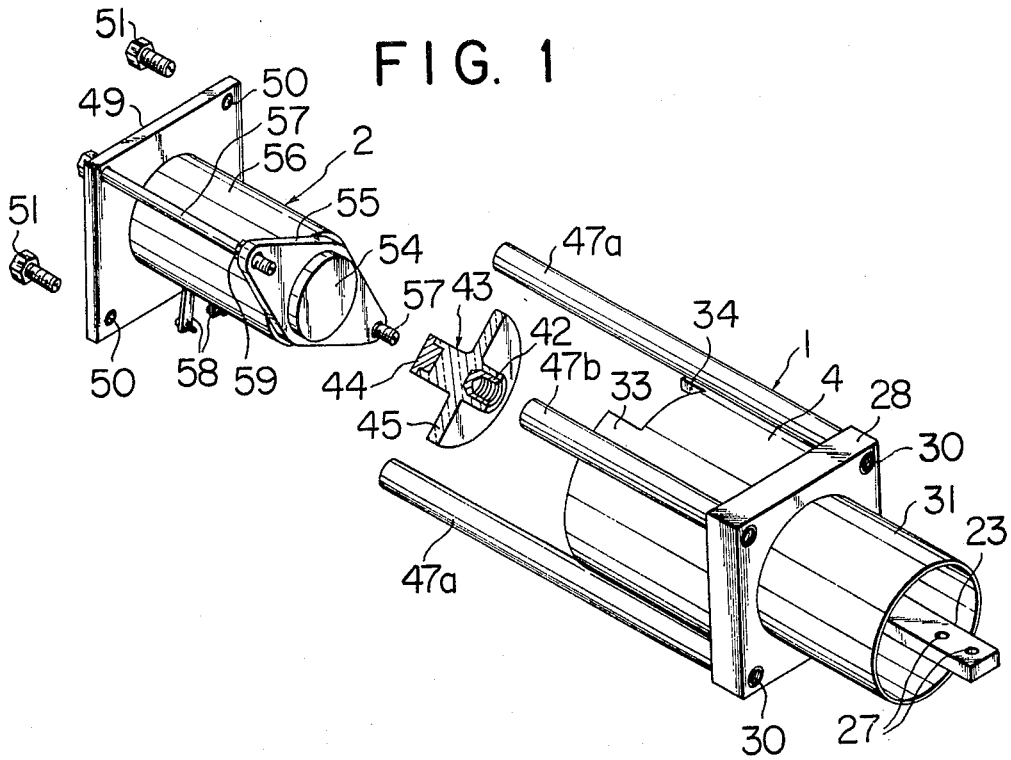
FIG. 1 is an exploded perspective view schematically illustrating a vacuum power interrupting device according to the present invention.

In FIGS. 1 and 3, reference numeral 58 denotes a terminal of winding 56, and reference numeral 59 denotes a lock nut threadedly connected to the end of connecting rod 57.

Reference is made to a method of mounting the vacuum interrupter to the board-plate. The method comprises the steps of fitting stationary barrier 31 of interrupting unit 1 into board wall 29 of the board-plate, threadedly connecting a screw (not shown) inserted from the inside of the board wall into metal fitting 30 of flange 28, and connecting the stationary and movable lead conductors 23 and 36 to connecting conductors 25 and 40 provided within the board-plate.

In operation, when winding 56 of the electromagnet within actuating unit 2 is energized in accordance with a command indicative of an opening operation of the vacuum interrupter, armature member 44 of insulating rod 43 is drawn towards iron core 52. As a result, movable contact rod 17 connected to insulating rod 43 moves in the left direction in FIG. 3. Thus, movable electrical contact 9 is moved away from stationary electrical contact 8 within vacuum interrupter 3.

When winding 56 is deenergized according to a command indicative of closing operation of the vacuum interrupter, movable electrical contact 9 is in contact with stationary electrical contact 8 due to the pressure differential between the inside of vacuum interrupter 3 and the outside thereof and the elasticity of bellows 15.

According to the present invention, there is provided a vacuum power interrupting device comprising a vacuum vessel consisting of a bell shaped metal casing, and an insulating ceramic end plate hermetically brazed to the opening end of the metal casing, and a vacuum interrupter constituted by a stationary contact rod having a stationary electrical contact supported by the bottom portion of the metal casing, and a movable contact rod having a movable electrical contact movably supported in the axial direction thereof by the bellows and disposed in the insulating end plate, wherein a stationary lead extending in the extending direction thereof and connected to the stationary contact rod, and the vacuum interrupter is molded by the supporting block of resin.

Accordingly, the abovementioned vacuum power interrupting device makes it possible to maintain the value of the creeping withstanding voltage between the insulating ceramic end plate and supporting block 4 to be higher than 50 KV per 10 mm, resulting in that the creeping withstanding voltage is the same magnitude as that of the creeping withstanding voltage of the insulating circular end plate in the atmosphere of vacuum. Accordingly, this makes it possible to become consistent between the creeping withstanding voltage inside of the vacuum interrupter and that outside thereof, thereby effectively enabling to improve the creeping surface flashover voltage.

The thermal stress due to a cold-heat cycle applied to the vacuum interrupter is adsorbed and relaxed by the metal casing. For this reason, there is no possibility that the vacuum interrupter will be broken. A contractive stress in the radial direction is applied to the insulating circular ceramic plate due to the difference between coefficient of thermal expansion of the insulating plate and that of the resin block. However, since the insulating end plate is formed with a flat disk, there is no possibility that it will be broken.

A flange is integrally formed on the side of bottom portion of the metal casing of the supporting block, and the insulating barrier which surrounds the stationary lead is integrally formed thereon. Accordingly, this makes it easy to connect or mount the vacuum power interrupting device for use in single, two or three phases to the board-plate. It is unnecessary to connect the stationary lead to a connecting conductor provided within the board-plate through the bushing as is required in the prior art.

Supporting block 4 is provided along the outer circumferential surface thereof integrally with a plurality of supporting poles 47*a* and 47*b* disposed in the moving direction of movable contact rod 17 and extending in the extending direction thereof. Magnetic core 52 of an electromagnet on which a winding 56 is wound, and extending in the extending direction of the plurality of supporting poles 47*a* and 47*b* is disposed in the center of the supporting poles. Further, the mounting plate 49 of magnetic material is mounted on the bottom portion of iron core 52. Further, the electromagnet is supported by connecting rod 57 of magnetic material provided on mounting plate 49. Furthermore, insulating rod 43 in which the armature member of a magnetic material is embedded at the position opposite to the top of the iron core is mounted on the movable contact rod.

This makes it possible to effectively incorporate the interrupting unit with the actuating unit and makes it easy to assemble them.

In the above embodiment, it is described that there are a plurality of supporting poles each having a length different from the other. However, the present invention is not limited to the above construction. For instance, all supporting poles may be small sized. In this instance, the actuating unit may be mounted by means of a connecting means of magnetic material. Furthermore, it is not limited that the actuating unit is constituted by an electromagnet. For instance, fluid pressure or air pressure actuating device may be used.

Obviously, numerous modifications and variations of the present invention are possible in light of the above teaching. It is therefore to be understood that within the scope of the appended claims, the invention may be practiced otherwise than as specifically described therein.

What is claimed is:

1. A vacuum power interrupting device comprising an interrupting unit, including a vacuum vessel therein, said unit adapted to be mounted to a stationary structure, and an integral actuating unit arranged in alignment with the interrupting unit to actuate the interrupting operation of the interrupting unit so that a movable contact contacts a stationary contact or is spaced therefrom, wherein a vacuum interrupter includes a stationary contact rod aligned with a movable contact rod, each rod having an electrical contact provided on an end thereof extending within the vacuum vessel, and a supporting block formed of synthetic insulating resin material in which substantially the entire peripheral surface of the vacuum interrupter is embedded, the improvement wherein said vacuum vessel comprises:

(a) a bell-shaped metal casing having an open end defined by a radially extending end portion, and (b) a single insulating circular end plate, said metal casing being fitted over said end plate with the radially extending end portion of the casing hermetically brazed to an outer peripheral edge of one side of said end plate.

2. A vacuum power interrupting device as claimed in claim 1, further including a stationary electrode lead electrically and threadedly connected to the stationary contact rod of said vacuum interrupter, said electrode lead being embedded at a root portion thereof in said supporting block and extending outwardly therefrom.

3. A vacuum power interrupting device as claimed in claim 2, further including a mounting flange integrally formed with said supporting block, a portion connecting said stationary lead to the stationary contact rod being embedded in said mounting flange, and a tubular insulating barrier extending outwardly from said supporting block so as to surround said stationary lead.

4. A vacuum power interrupting device as defined in claim 1, which further comprises an electromagnet for effecting an opening operation of the movable contact rod, said electromagnet being supported by a plurality of supporting poles extending along the outer circumferential surface of said supporting block.

5. A vacuum power interrupting device as claimed in claim 4, wherein at least one pole of said plurality of supporting poles serves as a magnetic path of said electromagnet.

6. A vacuum power interrupting device as claimed in claim 4, which further comprises an armature member of magnetic material responsive to said electromagnet and supported by an insulating block connected to the movable contact rod, said armature member being respectively in contact with or separated from a portion of said electromagnet in accordance with an energized or deenergized condition of said electromagnet to bring the vacuum interrupter into an interrupted condition or a closed condition.

* * * * *